United States Patent [19]

Weinert

[11] 4,421,050

[45] Dec. 20, 1983

[54] CARGO TORPEDO

[76] Inventor: Friedrich Weinert, 219-19-131st Ave., Jamaica, Queens, N.Y. 11413

[21] Appl. No.: 399,497

[22] Filed: Jul. 19, 1982

Related U.S. Application Data

[63] Continuation-in-part of Ser. No. 273,457, Sep. 23, 1970, abandoned.

[51] Int. Cl.[3] ..... B65D 89/10

[52] U.S. Cl. ..... 114/256; 114/74 T; 114/248

[58] Field of Search ..... 114/256, 59, 74 R, 74 A, 114/74 T, 72, 73, 321, 350, 248

[56] References Cited

U.S. PATENT DOCUMENTS

| | | | |
|---|---|---|---|
| 1,104,387 | 7/1914 | Razniak | 114/350 |
| 1,303,689 | 5/1919 | Leparmentier | 114/59 |
| 2,727,485 | 12/1955 | Combs | 114/321 |
| 3,376,841 | 4/1968 | Gill | 114/256 |
| 3,868,920 | 3/1975 | Schirtzinger | 114/321 |

*Primary Examiner*—Trygve M. Blix
*Assistant Examiner*—Jesus D. Sotelo

[57] ABSTRACT

A Cargo Torpedo comprises a floating semi-submerged vessel attached to a prime mover vessel by a stud installed in the center of the stern of a cargo vessel to match into an opening in the center into the bow of a prime mover vessel; the opening consists of a bushing to rotate with the motion of the cargo torpedo introduced by a plurality of mobile fins installed around the outer circumference of the cargo vessel whereby remote-controlled fins put in different angle positions synchronized in motion so the pitch of the fins will determine rotation or when put in neutral position stabilize the cargo torpedo, therefore, rotation of the cargo torpedo is transferred through the stud to a bushing of the prime mover vessel, whereby the bushing penetrates into the interior of the prime mover vessel to activate one or a series of generators or alternators to produce electricity needed to assist propulsion of the prime mover vessel.

3 Claims, 10 Drawing Figures

CARGO TORPEDO

The present application is a continuation-in-part of a previous application Ser. No. 273,457 dated Sept. 23, 1970, now abandoned.

BACKGROUND OF THE INVENTION

According to the present invention, there is provided a semi-submerged vessel in hydro dynamic shape similar to a torpedo to reduce the resistance when pushed through water, the concept of a semi-submerged transport system is not new as shown in reference by H. M. Combo U.S. Pat. No. 2,727,485 Dec. 29, 1955 and Joseph F. Schirtzinger U.S. Pat. No. 3,868,930 Mar. 4, 1975. All these designs have failed to take the advantage of a heavy mass in motion to produce energy, additionally the danger factor of sinking is increased so therefore no substantial benefit is obtained, not so with the present invention. The ability to rotate a Cargo Torpedo makes this design superior by reducing the cost of fuel, increasing the safety factor and can mix large amounts of liquid without additional costs and finally the prime mover of the vessel can be engaged and disengaged which reduces harbor expense. In order to have the Cargo Torpedo rotating a stud at the center of stern of cargo vessel is joined into the bow of a prime mover vessel which propels the cargo vessel, meaning the cargo vessel is pushed against the sea current by attached prime mover vessel. The rotation of the cargo vessel is introduced by fins installed around the circumference of the cargo vessel with a corrugated surface to take advantage of sea current when confronted from the side. The rotation of the vessel is transmitted to an alternator installed on the inside of the prime mover vessel to produce electricity which in return is used to supply the prime-mover with energy. The prime mover can be an engine of any design, but a fluid heat engine becomes most practical because electricity created during rotation of the cargo vessel can heat the fluid to drive the engine as the surrounding sea water cools the fluid to introduce a fast active thermo dynamic cycle. The inventor of this invention has already designed such a Heat Engine under the title "Compact Spindle Drive" Ser. No. 278,415. The engine activates the gear box to rotate the propeller shaft to propel the vessel, meaning the prime mover vessel operates the cargo vessel. In this fashion, no exhaust gases are involved as long as the heat source is generated from electricity or radio isotopic heat elements. Further objects and advantages of the invention will be apparent from the following description of the invention.

SUMMARY OF THE INVENTION

Accordingly, it is a primary object of the present invention to construct a semi-submerged cargo vessel able to transport liquid cargo from the polar region to any destination. The uniqueness of this design is: that the cargo vessel can rotate as it is pushed forward by a separate prime mover vessel. The rotation is introduced by mobile fins which can be placed in different angle positions controlled by the prime mover vessel. The rotation of the cargo vessel makes it possible to transport mineral water which otherwise would freeze, Additionally the rotation improves the safety of a vessel by making it almost impossible to sink or lose cargo regardless of any damage, like a hole or crack as it occurs by a collision. This would reduce insurance rates drastically and furthermore the main principle of the invention is to carry mineral water from the polar regions to be mixed with minerals and nutrients found only deep in the ocean. Today scientists agree that cancer is caused mainly by pollution one way or another and the best prevention is to drink alot of healthy mineral water. But high quality mineral water is expensive and scarce. The vessel of this invention would solve this problem because it is made possible by the rotation of the vessel which is converted into electricity inside a primer mover vessel which joins the cargo torpedo at the stern. I discovered a large cylinder well balanced several tons heavy floating in water can easily be rotated by the strength of a human being but can not be stopped by the same motion it would take many more people to do so meaning the energy needed to rotate the vessel is surpassed by the motion of the vessel made possible by gravitational forces, meaning the greater the mass in motion less the resistance. The Cargo Torpedo has a corrugated surface so water masses can get a hold on it to rotate the vessel. In general, a vessel always travels on an angle against the sea current. This is the most favorable position for the Cargo Torpedo which now converts the forward motion and sea current into one rotation. This makes the invention very unique in comparison to other semi-submerged transport systems. The rotation can be increased by fins which can be moved in different angles remote controlled from the prime mover vessel. Whenever a damage occurs which creates a leak then that damaged area can be rolled to the top and therefore locked into position by the prime mover vessel. The prime mover vessel pushes the Cargo Torpedo and regulates the rotation of the Cargo Torpedo. This brings another advantage when the unit has docked at the pier the prime mover vessel can disengage and separate itself from the Cargo Torpedo to engage itself to another cargo vessel ready for shipping. Further objects and advantages of the invention will be apparent from the following description of the invention.

DETAILED DESCRIPTION OF A PREFERRED EMBODIMENT

Figure 1:
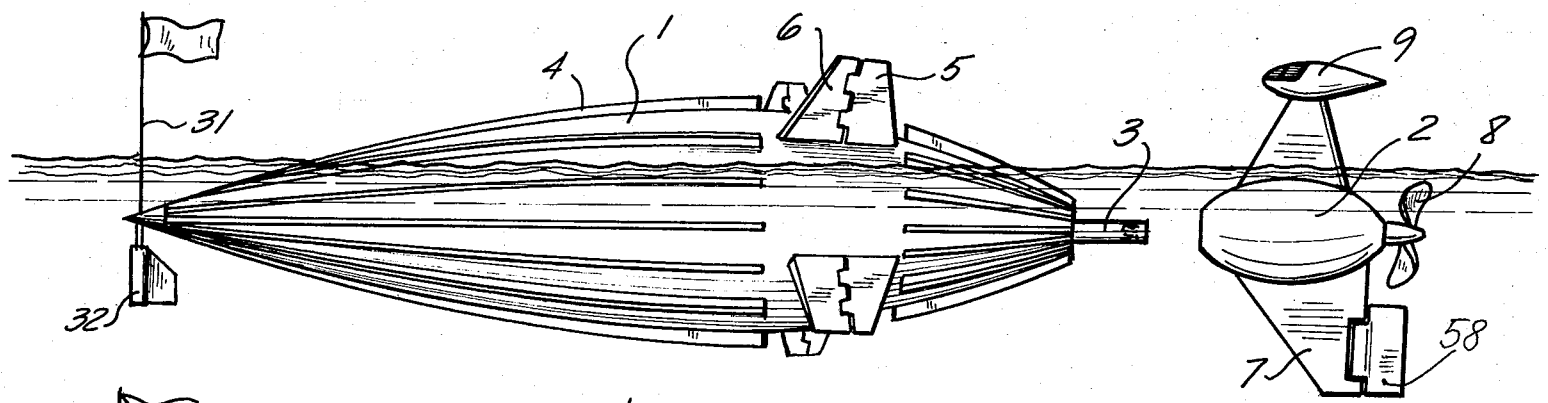
FIG. 1 is an explanatory side view of a Cargo Torpedo separated from a prime mover vessel.
Figure 2:
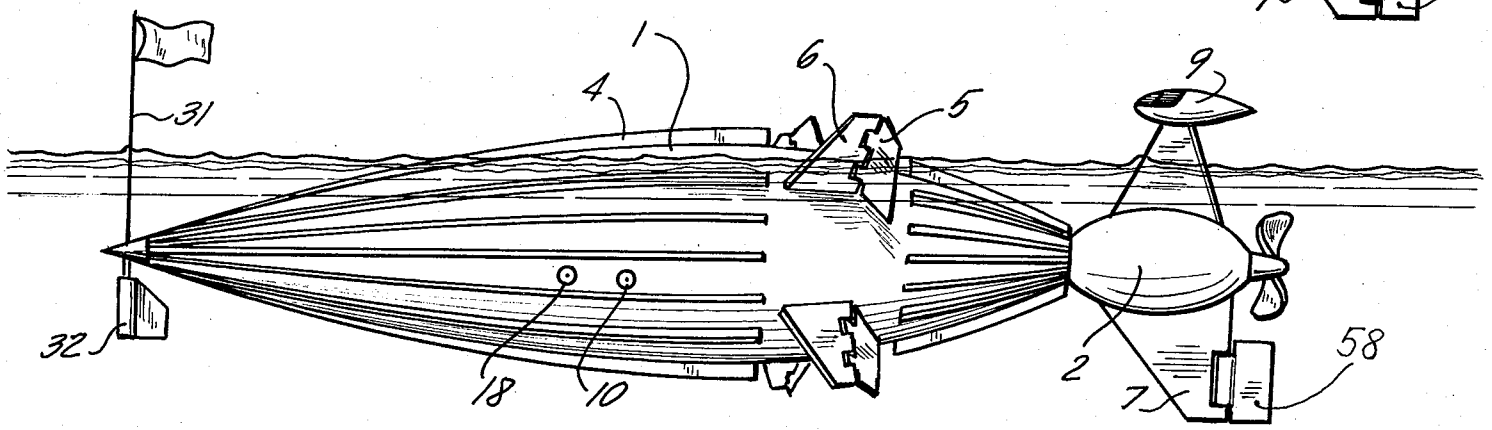
FIG. 2 is an explanatory side view of a Cargo Torpedo engaged with a prime mover vessel.
Figure 3:
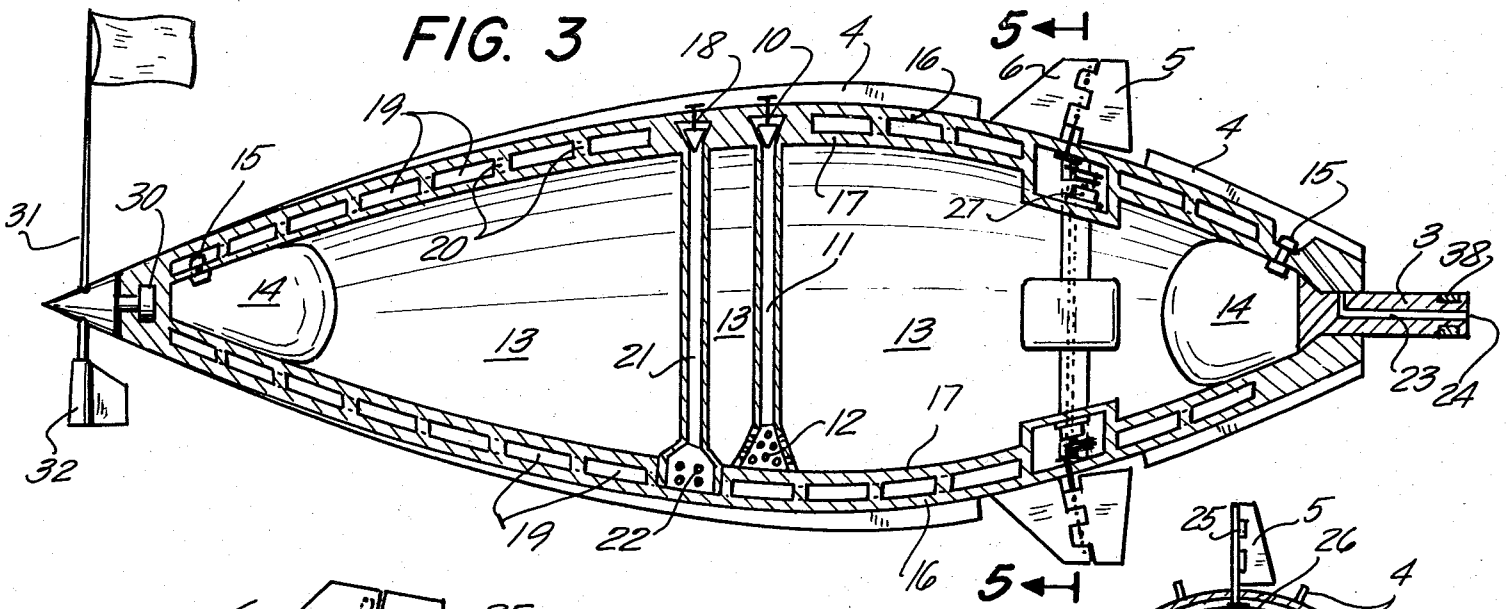
FIG. 3 is a partly sectional explanatory view of a Cargo Torpedo.
Figure 5:
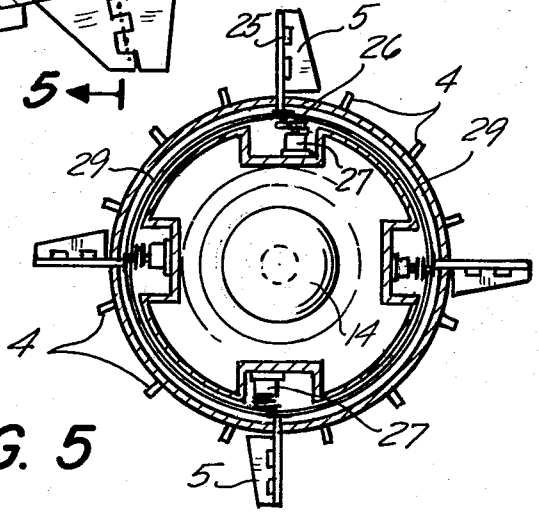
FIG. 5 is a sectional front view of the mobile fin mechanism.
Figure 4:
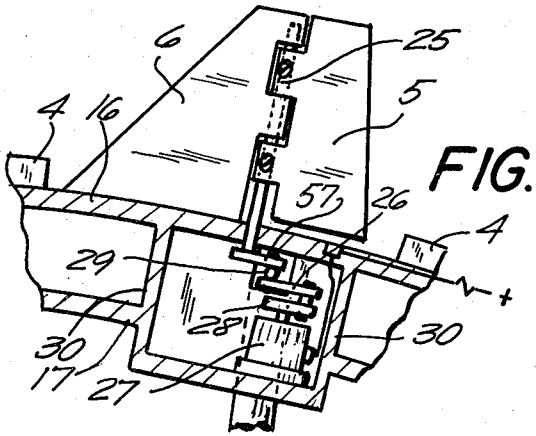
FIG. 4 is a partly sectional explanatory view of the mobile fin section.
Figure 6:
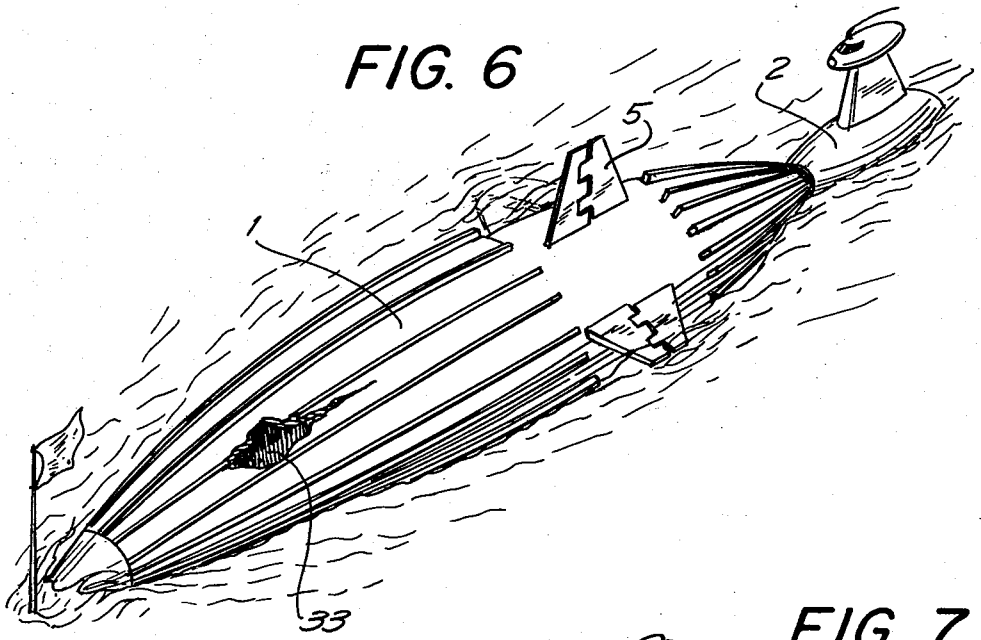
FIG. 6 is a perspective view of a Cargo Torpedo with damanged top surface.
Figure 7:
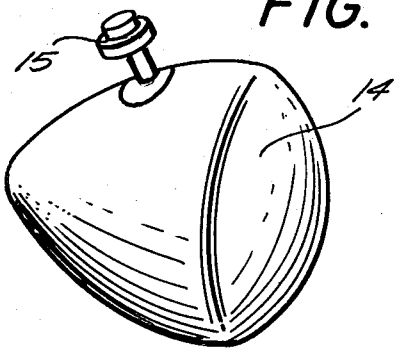
FIG. 7 is a perspective view of an air pillow as shown in FIG. 3 (14).
Figure 8:
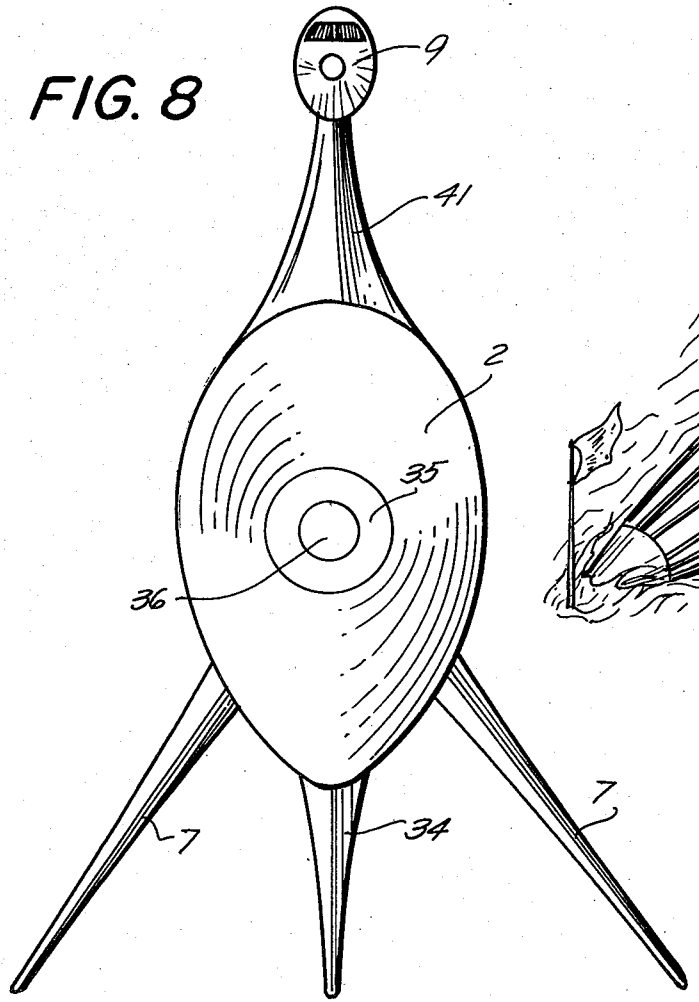
FIG. 8 is a plain front view of the prime mover vessel.
Figures 9, 10:
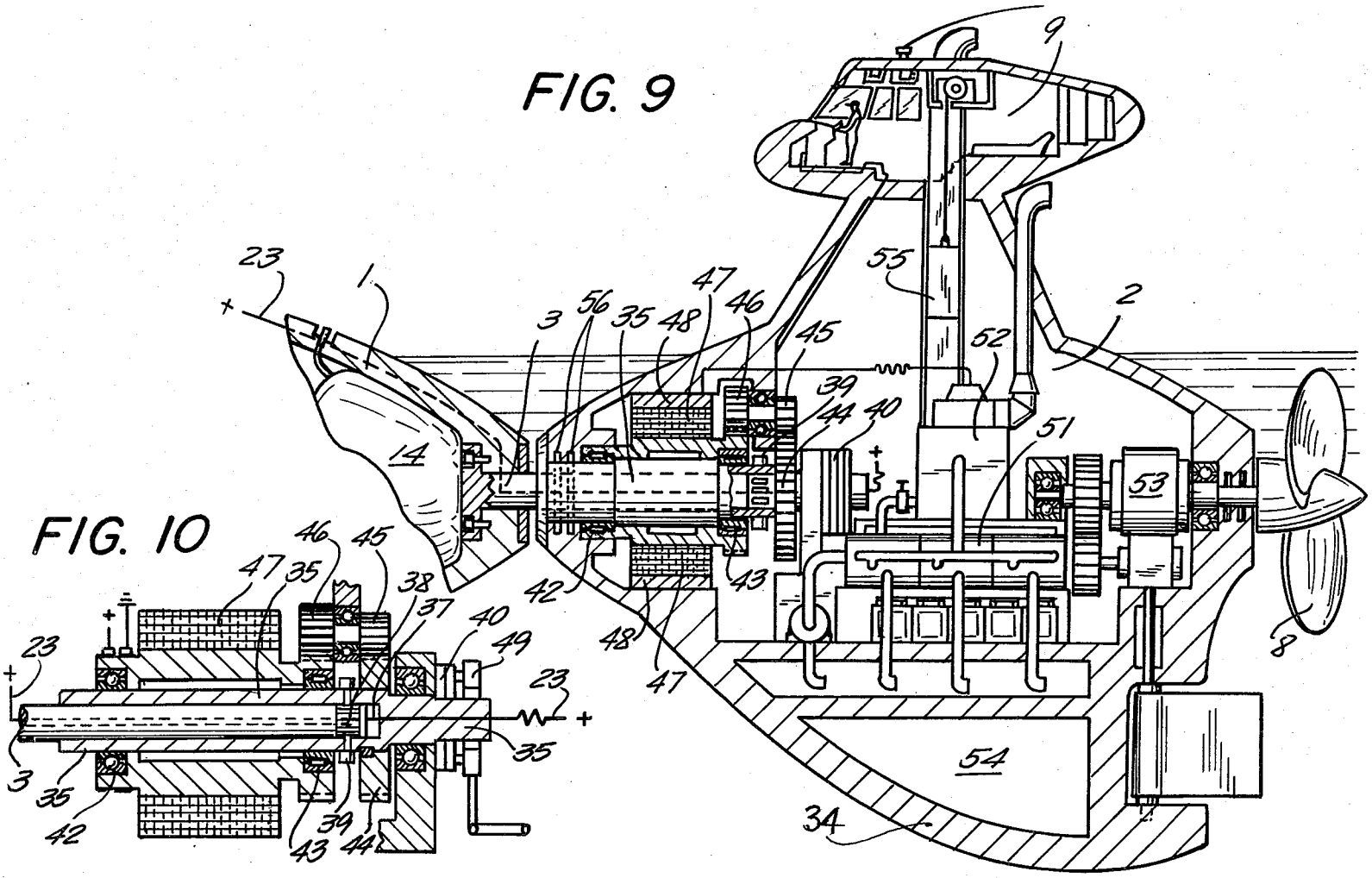
FIG. 9 is a partly sectional explanatory view of a prime mover vessel joined into the rear axis of the Cargo Torpedo.
FIG. 10 is a cross section view of the mobile armature of the alternator including accelerator gears, stud cylinder and stud.

Referring to FIG. 1 (1) there is shown a Cargo Torpedo with a disengaged prime mover vessel (2). The connection between the two vessels is made through a stud mounted in the center of the stern from a cargo vessel which fits into an opening of the bow of the prime mover vessel as shown in FIG. 1(3). Mobile fins (5) installed against stationary fins (6) will increase or stabilize the rotation. The prime mover vessel FIG. 8 consists mainly of body (2) ballast fins (7) steering fins (34) and command bridge (9) and propeller FIG. 9(8). FIG. 2 shows a Cargo Torpedo (1) engaged with prime mover vessel (2). Mobile fins (5) are turned to rotate the vessel to the left. In order to load the vessel, filler valve (10) must be maneuvered to the top as shown in FIG. 3. The filler valve is placed at the highest point of the vessel so liquid cargo can enter through the valve into filler pipe (11) and bottom filter (12) into cargo vessel (13). Inside the cargo vessel air pillows (14) are installed to allow the cargo to contract or to expand. The Cargo Torpedo can only function properly when cargo vessel is completely empty or full in order to be perfectly balanced. To float this vessel the empty space in between the outer shell (16) and inner shell (17) is used to keep the vessel afloat through air chambers (19) called ballast space strengthened by spans (20) with holes in between the outer and inner shell. The holes in the span allow ballast waters to circulate. When the space (13) is almost filled with liquid, air pillows (14) must now be pressurized through air pressure charger valve (15). To disconnect or connect cargo vessel with prime mover vessel a stud is installed exactly in the center of the stern from the cargo vessel which must be inserted into an opening in the bow of the prime mover vessel, the opening conceals the stud through a bushing FIG. 9(35). The bushing can rotate with the motion of the stud (3). To prevent sea water from penetrating into the prime mover vessel seal rings (56) are installed. The bushing (35) is centralized inside the vessel through bearings (42 and 43). A mobile armature (47) of an alternator is fitted around the bushing (35) and centralized by the same bearing (42 and 43). At the very end of bushing (35) a drive gear (44) is fixed against the bushing which is intermeshing with a double acceleration gear (45 and 46). Acceleration gear (46) is intermeshing with a drive gear fixed against mobile armature (47) therefore slow rotation of drive gear (44) is accelerated by acceleration gear (46) to rotate mobile armature (47) around bushing (35). The rotation of the cargo vessel is controlled by fins and disc brakes (40); to activate fins in different positions a positive wire lead FIG. 10 (23) makes contact with the electro motors inside the cargo vessel by a positive lead FIG. 10(23) penetrating bushing (35) to make contact by a contact brush (37) in the center of the stud (3) to be guided through the stud FIG. 3 (23) to the electric motors FIG. 4(27) to activate mobile fins FIGS. 3–4(5). The fins are moved by a hinge axle (25) which is joined to a linkage (26) activated by an electromotor (27) through lever (28) which rotates in one direction. Linkage (26) converts the rotation from lever (28) into stroke action to move mobile fins (5) to the right or left. To convert this motion evenly to all mobile fins a linkage (29) made from spring steel connects all stroke actions from linkage (26) to each mobile fin as shown in FIG. 5 in order to synchronize fins into the same position. Naturally the moving parts of the mobile fins are installed in a hermetically sealed space as shown in FIG. 4 behind walls (30). FIG. 5 shows a front cross section of the Cargo Torpedo to indicate how mobile fins (5) are connected to hinge axle (25) and connected to linkage (26) which is linked to control linkage (29) installed in between the lever of motor FIG. 4(28) and lever of hinge axle (57) put in motion by motor (27). The entire mechanism is concealed between the inside shell (17) and outside shell (16) and divider wall (30). The mechanism to move the mobile fins explained herein, is a well known design used by water sprinklers or fans to put the sprinklers or fans into motion from right to left and from left to right. Naturally, other designs can be used as well, the purpose of the fins is to control the rotation of cargo vessel. Depending on the pitch, meaning angle position of fins, and forward motion will determine the rotation of cargo vessel. The fins can also stop the rotation of cargo vessel when put into neutral position. Additionally, sea current encountered from the side or wide angles will apply torque to rotate the cargo vessel. Whenever the cargo vessel floats without cargo, ballast water must be pumped through ballast valve FIG. 3(18) into ballast pipe (21) through filter (22) to fill ballast space (19), meaning cargo is pumped in or out through filler valve (10. Ballast water is pumped in or out through ballast valve (18). This process does not differentiate with other buoyancy procedure, meaning when the cargo space in the vessel is empty, the cargo vessel will rise, therefore, ballast is added to maintain the most practical water level in order to keep the propeller (8) of prime mover vessel(2) under water. FIG. 6 shows a perspective view of a Cargo Torpedo (1) pushed by a primer mover (2) in order to keep a defected surface (33) on top without the rotation of the vessel; therefore mobile fins (5) must be put in neutral position as shown in FIG. 6 and stud (3) is locked through disc brakes FIG. 9(40). FIG. 7 shows the air pillows (14) which can be pressurized by air pressure valve (15). FIG. 8 shows a plain front view of the cargo vessel (2) whereby the stud cylinder (35) and opening (36) is put in center of the bow of prime mover vessel. Steering fin (34) divides the space between ballast fins (7). The command bridge (9) is placed at the top of the prime mover vessel by an extension structure called neck (41). FIG. 9 is a partly sectional explanatory view of a prime mover linked together with a Cargo Torpedo vessel. The connection is made through stud (3) and stud cylinder (35) till lock screw (39) snaps in lock groove FIG. 10 (38). This secures the connection between both vessels. When Cargo Torpedo starts to rotate stud bushing will rotate by the same motion. The stud cylinder is kept between front bearing (42) and rear bearing (43) in such a fashion that drive gear (44) will rotate accelerator gear (45) which will accelerate drive gear (46) to rotate armature (47) from the alternator, (48) meaning (47) shows the rotating armature called rotor. (56) indicates the seals around the stud cylinder to prevent leakage from the water pressure on the outside. (40) shows disc brakes used to slow down and stop rotation. FIG. 10 shows the same section somewhat enlarged without the stationary armature, (48) meaning mobile armature or rotor (47) is supported by two bearings (42 and 43) to rotate around stud bushing (35) made possible by drive gear (44) which is locked against the stud bearing to drive accelerator gear (45) which will accelerate drive gear (46) to rotate armature (47) around stud bushing (35) introduced by the motion of stud (3). The rotation can be slowed down or stopped by disc brakes (40) and brake caliper (49). It is understood that the rotating bushing (35) can activate more than one alternator or generator depending on the design. The drawing of FIG. 9 illustrates in the most simple and practical way how rotation of stud (3) can activate an alternator. The electricity needed to rotate the motors FIG. 4 (27) to activate mobile fin gears, is supplied by a wire lead (23) and contact brush (37). In general, only one positive lead is needed to activate the electric motors of the mobile fins as long as the structure of the Cargo Torpedo is grounded to the negative side of the motors. Naturally, several wire leads by different contact rings and contact brushes can be applied to it. The electricity gained from the rotation of the cargo vessel is used to supply some of the energy needed to activate prime mover FIG. 9(51) by heat source (52) which will activate gear box (53) to rotate propeller (8). Space (54) inside steering fin (34) is used to cool a working fluid if needed for prime mover (51). Ballast fins FIGS. 8 and 2(7) are hollow in order to use the hollow space inside the fins for ballast to level the vessel. Additionally, the rudder (58) is also used to level the vessel, therefore, the right and left rudder from the ballast fins can be activated individually, as the rudder from the steering fin is used only to direct the vessel. All controls are installed in the command bridge FIG. 9(9). The access from the command bridge to the engine room is achieved by elevator or stairs (55).

I claim:

1. A cargo vessel system comprising a floating semi-submerged hull and a prime mover vessel; said hull being rotatable about its longitudinal axis and including stud means centralized at the stern thereof; said prime mover vessel including an opening at its bow adapted to matingly receive said stud means to couple said hull to said prime mover vessel; said rotatable hull including a plurality of remote-controlled fins installed around the circumference of the hull; and control means for selectively adjusting the angle of attack of said fins such that in a first position the fins create a turning moment to rotate the hull by the forward motion of the hull while in a second position the fins create a stabilizing force to prevent the hull from rotating.

2. A Cargo vessel system as recited in claim 1 wherein the floating hull is corrugated or indented on the outside to achieve drag action when encountering sea current in order to rotate the hull.

3. A Cargo vessel system as recited in claim 1 wherein air pillows in the center of each end inside the hull, when inflated by means of air pressure, pressurizes the liquid contents inside the hull.

* * * * *